US009341151B2

(12) United States Patent
Arens et al.

(10) Patent No.: US 9,341,151 B2
(45) **Date of Patent: *May 17, 2016**

(54) FUEL PUMP

(75) Inventors: Holger Arens, Berlin (DE); Lars Arens, Berlin (DE); Christian Gladosch, Berlin (DE)

(73) Assignee: ARENS GMBH METALLBAU & BAUSCHLOSSEREI, Berlin (DE)

( * ) Notice: Subject to any disclaimer, the term of this patent is extended or adjusted under 35 U.S.C. 154(b) by 170 days.

This patent is subject to a terminal disclaimer.

(21) Appl. No.: 14/130,299

(22) PCT Filed: Jun. 28, 2012

(86) PCT No.: PCT/EP2012/062636

§ 371 (c)(1),
(2), (4) Date: Apr. 9, 2014

(87) PCT Pub. No.: WO2013/001036

PCT Pub. Date: Jan. 3, 2013

(65) Prior Publication Data

US 2014/0216417 A1 Aug. 7, 2014

(30) Foreign Application Priority Data

Jun. 30, 2011 (DE) ..... 10 2011 078 466
Jun. 30, 2011 (DE) ..... 10 2011 119 519

(51) Int. Cl.
*F02M 39/02* (2006.01)
*F02M 37/04* (2006.01)
(Continued)

(52) U.S. Cl.
CPC ..... *F02M 37/043* (2013.01); *F04B 1/0404* (2013.01); *F04B 1/0413* (2013.01); *F04B 9/045* (2013.01); *F04B 53/18* (2013.01); *F02M 39/02* (2013.01); *F02M 59/06* (2013.01)

(58) Field of Classification Search
CPC ..... F02B 67/06; F02B 67/04; F02B 9/02; F02M 39/02
See application file for complete search history.

(56) References Cited

U.S. PATENT DOCUMENTS 666,264 A 1/1901 Denison
3,074,625 A 1/1963 Paterson et al.
(Continued)

FOREIGN PATENT DOCUMENTS

CH 404 292 A 6/1966
CH 404292 A 6/1966
(Continued)

OTHER PUBLICATIONS

Drehschiebermotor (image) Wikipedia, retrieved Oct. 12, 2013.

*Primary Examiner* — Lindsay Low
*Assistant Examiner* — Kevin Lathers
(74) *Attorney, Agent, or Firm* — Maschoff Brennan

(57) ABSTRACT

The invention relates to an engine system comprising a fuel pump for compressing fuel. The fuel pump having at least two compression pistons, an eccentric chamber in which the at least two compression pistons are mounted in axially displaceable fashion, and a rotatably mounted eccentric for driving the at least two compression pistons is accommodated in the eccentric chamber, wherein the eccentric and the at least two compression pistons are operatively connected to one another such that the two compression pistons are axially displaced for the compression of fuel. Provision is made, here, for the eccentric chamber to be at least partially filled with lubricant.

7 Claims, 9 Drawing Sheets

(51) Int. Cl.

| | |
|---|---|
| ***F04B 1/04*** | (2006.01) |
| ***F04B 9/04*** | (2006.01) |
| ***F04B 53/18*** | (2006.01) |
| *F02M 59/06* | (2006.01) |

(56) References Cited

U.S. PATENT DOCUMENTS

| | | | | |
|---|---|---|---|---|
| 3,119,340 | A * | 1/1964 | Scibbe | 74/837 |
| 3,603,331 | A | 9/1971 | Tanner | |
| 4,079,706 | A | 3/1978 | König | |
| 4,445,468 | A | 5/1984 | Onishi et al. | |
| 7,011,012 | B2 | 3/2006 | Hartsleben et al. | |
| 2007/0227509 | A1 | 10/2007 | Ueda et al. | |
| 2010/0206279 | A1 | 8/2010 | Grossi | |

FOREIGN PATENT DOCUMENTS

| | | | |
|---|---|---|---|
| DE | 804 978 | C | 5/1951 |
| DE | 804978 | C | 5/1951 |
| DE | 2628696 | A1 | 1/1977 |
| DE | 26 08 818 | A1 | 9/1977 |
| DE | 2608818 | A1 | 9/1977 |
| DE | 30 06 327 | A1 | 8/1980 |
| DE | 3006327 | A1 | 8/1980 |
| DE | 30 33 557 | A1 | 6/1981 |
| DE | 3033557 | A1 | 6/1981 |
| DE | 3145005 | A1 | 7/1982 |
| DE | 3531287 | C2 | 2/1994 |
| DE | 4305791 | A1 | 9/1994 |
| DE | 4315826 | A1 | 11/1994 |
| DE | 19716242 | A1 | 10/1998 |
| DE | 19826961 | A1 | 12/1998 |
| DE | 19800274 | A | 7/1999 |
| DE | 19800274 | A1 | 7/1999 |
| DE | 102009029159 | A1 | 3/2001 |
| DE | 10109457 | A1 | 9/2002 |
| DE | 19643886 | C2 | 10/2002 |
| DE | 102005007839 | B3 | 5/2006 |
| DE | 102007047903 | A1 | 12/2008 |
| DE | 102008042371 | A1 | 4/2009 |
| DE | 102008010781 | A1 | 9/2009 |
| DE | 20 2009 012 268 | U1 | 1/2010 |
| DE | 202009012268 | U1 | 1/2010 |
| DE | 102008050381 | A1 | 4/2010 |
| EP | 0507191 | A1 | 10/1992 |
| EP | 0853194 | A2 | 12/1998 |
| EP | 1041259 | B1 | 10/2000 |
| EP | 1642013 | B1 | 4/2006 |
| FR | 679.780 | A | 4/1930 |
| FR | 679780 | A | 4/1930 |
| FR | 1.162.601 | A | 9/1958 |
| FR | 1162601 | A | 9/1958 |
| FR | 2 444 797 | A1 | 7/1980 |
| FR | 2444797 | A1 | 12/1980 |
| GB | 22241 | A | 0/1910 |
| GB | 193598 | A | 3/1923 |
| GB | 2111591 | A | 7/1983 |
| JP | 3945005 | B2 | 12/2007 |
| JP | 2010007622 | A | 1/2010 |
| WO | 95/12750 | A1 | 5/1995 |
| WO | 01/92709 | A2 | 12/2001 |

* cited by examiner

FUEL PUMP

CROSS-REFERENCE TO A RELATED APPLICATION

This application is a National Phase Patent Application of International Patent Application Number PCT/EP2012/062636, filed on Jun. 28, 2012, which claims priority of German Patent Application Number 10 2011 119 519.3, filed on Jun. 30, 2011 and of German Patent Application Number 10 2011 078 466.7, filed on Jun. 30, 2011.

BACKGROUND

The invention relates to an engine system comprising a fuel pump.

A high-pressure fuel pump is known for example from DE 197 16 242 A1. Said patent describes a high-pressure fuel pump with multiple pump pistons which are arranged at angular intervals with respect to one another about a central drive shaft. The pump pistons bear, by way of their radially inner ends and under the action of preloaded springs, against an output ring of an eccentric shaft part, and are in each case guided in an axially displaceable manner in a guide bore.

A disadvantage of said high-pressure fuel pump is the fact that the pump pistons and the output ring are subject to intense abrasion forces, and consequently increased material outlay is required in order to counteract wear phenomena.

SUMMARY

The invention is based on the object of providing an improved engine system.

The engine system comprising a fuel pump according to an exemplary embodiment of the invention for compressing fuel, in particular for compressing fuel to high pressure, has at least two compression pistons. Furthermore, the fuel pump has an eccentric chamber in which the at least two compression pistons are mounted in axially displaceable fashion, and a rotatably mounted eccentric for driving the at least two compression pistons is accommodated in the eccentric chamber, wherein the eccentric and the at least two compression pistons are operatively connected to one another such that the two compression pistons are axially displaced for the compression of fuel. Here, the eccentric chamber is at least partially filled with lubricant. By means of lubrication of the rotating parts in the eccentric chamber, the load on the respective materials is reduced considerably, and the service life is lengthened considerably.

In an alternative embodiment, at least one closable opening may be provided on the eccentric chamber in order to enable the lubricant to be discharged from the eccentric chamber, for example under the action of gravity. Alternatively, the opening may also be provided for the supply of new lubricant into the eccentric chamber. A further opening for supply purposes is likewise conceivable.

In particular, the eccentric may be composed of a rolling bearing which is seated on a cranked portion of a coupling shaft and which is arranged within an eccentric chamber (and/or a rolling bearing chamber), wherein the compression pistons bear by way of their radially inner ends against the outer circumferential surface of the outer rolling ring of the rolling bearing.

Furthermore, the outer circumferential surface of the eccentric or outer rolling ring may be in the form of an output ring composed of hardened material. Here, the outer circumferential surface of the eccentric or outer rolling ring is operatively connected to the lower end of the compression piston.

The transmission of force to the compression pistons may for example take place via a cranked coupling shaft to the outer circumferential surface of an outer rolling ring, which is operatively connected to the compression pistons, by means of the rolling bearing via rolling bodies which are arranged between the outer rolling ring and the inner rolling ring of the rolling bearing. The rolling bearing may for example be in the form of a ball bearing or needle-roller bearing.

In a further exemplary embodiment, the fuel pump comprises in each case one cylinder liner for in each case one compression piston, wherein the cylinder liner has a radially elastic mounting. Such a mounting may be realized for example by means of one or more elastomer rings. It is alternatively or additionally possible for the cylinder liner of the compression piston to be mounted in axially elastic fashion. This may be realized for example by means of a plate spring.

By means of the solution according to the invention, it is possible to provide a fuel pump which, with low outlay in terms of material and installation space, considerably reduces the load on the material of the individual components and permits smooth operation. The elastic flexibility of the cylinder liner mounting achieved in this way minimizes considerably the edge loads between the cylinder liner and the compression piston.

The fuel pump is suitable in particular for compression of fuel to high pressure for a two-stroke internal combustion engine with direct injection and with working cylinders in a boxer arrangement. In addition to a two-cylinder boxer arrangement, it is also conceivable for four cylinders, six cylinders or more to be provided. The use of the fuel pump is not restricted to internal combustion engines with working cylinders in the boxer arrangement, and the fuel pump may for example also be used in the case of in-line engines.

The engine system may also provide a rotary disk valve arrangement for controlling the air flowing into a crankcase.

It is known that the ingress of fresh air into a crankcase can be controlled by means of a rotary valve system. DE 35 31 287 C2 in particular describes a two-stroke internal combustion engine in which the supply of fresh air into the crankcase of the internal combustion engine can be controlled by means of displaceable control edges which are arranged in a rotary valve housing which is seated fixedly on the crankcase of the internal combustion engine. The patent describes a circular-segment-shaped rotary valve which is connected rotationally conjointly to a crankshaft and which has a closing edge at the front in the direction of rotation and an opening edge at the rear in the direction of rotation and which is arranged within a rotary valve housing mounted on the crankcase. Here, the wall of the crankcase has an inlet opening with control edges on both sides in the direction of rotation of the rotary valve, and has an intake opening in the opposite wall of the rotary valve housing, said intake opening being situated opposite the inlet opening and having control edges. Furthermore, at least one of the control edges in the rotary valve housing wall is displaceable relative to the corresponding control edge of the inlet opening of the crankcase as a function of the crankshaft rotational speed. Here, the two control edges are designed such that, as the rotational speed increases, the opening angle of the rotary valve control unit is enlarged overall, whereas at low rotational speed, the opening angle is reduced in size overall. The described solution serves for varying the inlet timing as a function of the rotational speed. Separate throttling of the supply of fresh air is not provided.

Disadvantages of said arrangement are that no separate throttling of the supply of fresh air is possible, and that lubrication of the rotary valve arrangement is possible only by means of a separate, additional device.

This disadvantage can be eliminated by means of a modified rotary disk valve arrangement. Accordingly, the rotary disk valve arrangement provides a crankcase for accommodating a crankshaft, wherein the crankcase has an inlet opening for fresh air and at least two rotary disk valves for regulating an ingress of fresh air into the crankcase. Wherein the at least two rotary disk valves have an axis of rotation and are mounted so as to be rotatable relative to one another for the purpose of at least partially opening up and closing off the one inlet opening. Here, the at least two rotary disk valves are arranged on the crankcase at a coupling surface of the crankcase.

Here, at least one further inlet opening is provided on the coupling surface, and the at least two rotary disk valves comprise in each case at least two rotary valve openings for the purpose of at least partially opening up the at least two inlet openings.

It may be provided in particular that the crankshaft of the crankcase is operatively connected to at least one piston of at least one working cylinder.

Furthermore, the rotary disk valve arrangement comprises at least one first and/or one second cover with in each case at least two cover openings.

In particular, the coupling surface of the crankcase and the first cover form a first rotary disk valve chamber, wherein the at least two first cover openings of the first cover can be placed at least partially in overlap with the inlet openings of the crankcase. Here, the area of the first cover opening may correspond to the area of the inlet opening of the crankcase.

It may be provided in particular that the first cover openings and/or the second cover openings can be placed entirely in overlap with the inlet openings of the crankcase. It is also conceivable for the area of the first cover openings and/or of the second cover openings to be larger or smaller than the area of the inlet opening of the crankcase.

It may furthermore be provided that the at least two inlet openings of the crankcase are designed with point symmetry with respect to the axis of rotation of a crankshaft arranged in the crankcase. It may alternatively or additionally be provided that the cover openings of the first and/or of the second cover are designed with point symmetry with respect to the axis of rotation of the first and/or of the second rotary disk valve.

In a further exemplary embodiment, a seal may be provided between the coupling surface of the crankcase and the first cover, which seal is designed so as to prevent an escape of air from the crankcase. A positive pressure is generated in the crankcase in particular during downward movements of the piston into the working cylinder, which positive pressure pushes the first rotary disk valve away from the crankcase toward the first cover. Owing to the arrangement of the seal between the crankcase and the first cover, an escape of the air is virtually completely prevented, and thus a drop in the scavenging pressure is minimized.

In particular, the first rotary disk valve may be arranged, operatively connected in a positively locking fashion to a coupling shaft, in particular to a cranked coupling shaft, and rotatably mounted in the first rotary disk valve chamber. Here, the coupling shaft, or the cranked coupling shaft, may be connected via a gearing to the crankshaft such that the coupling shaft, or the cranked coupling shaft, rotates at a lower rotational speed than the crankshaft. In particular, a rotational speed of the coupling shaft, or of the cranked coupling shaft, may correspond to half of the rotational speed of the crankshaft.

Here, the first rotary disk valve may have at least two first rotary valve openings which are designed such that they can be placed at least partially in overlap with the inlet openings of the crankcase and/or with the cover openings of the first cover by means of a rotational movement of the first rotary disk valve.

Here, the rotary disk valve may have a substantially circular circumference. Furthermore, the rotary valve openings of the first rotary disk valve may be oriented concentrically and extend over an angle range, defined by the angle between the side edges of the rotary valve openings and the axis of rotation of the rotary disk valve, of between 0 and 180°.

The opening of the rotary disk valve may in particular be dependent on the transmission ratio between the first rotary disk valve (and thus the coupling shaft) and the crankshaft. Provision may also be made for the supply of fresh air to be made dependent on the position of the pistons of the working cylinders. The opening of the rotary disk valve can be defined by the following formula:

$$\theta=0.5\times i\times(\gamma-\alpha),$$

where the values are defined as follows:

$$\gamma=\begin{cases}\beta, & (180^\circ<\beta\leq 360^\circ)\wedge(\beta>\alpha)\\ \beta+360^\circ, & (0^\circ<\beta\leq 180^\circ)\end{cases}$$

and $$\alpha:\ 180^\circ\leq\alpha<360^\circ$$

and $$0<i=\frac{n_{rotarywalve}}{n_{crankshaft}}\leq 1$$

α: corresponds to the crank angle in [° CA], at which the crankcase is opened

β: corresponds to the crank angle in [° CA], at which the crankcase is closed i: corresponds to the transmission ratio between the coupling shaft (or first rotary disk valve) and crankshaft θ corresponds to the angle range of the rotary disk valve opening n: corresponds the rotational speed of the rotary valve or of the crankshaft respectively Here, the position of the crankshaft in which the piston of the at least one working cylinder is situated at top dead center (TDC) is designated as 0° crankshaft position (CA). At 180° CA, the piston is situated at bottom dead center (BDC), and after one complete revolution (360° CA), the piston is situated at top dead center (TDC) again. Consequently, the upward movement of the piston takes place between 180-360° CA. When the piston performs an upward movement, a negative pressure is then generated in the crankcase. Fresh air can be drawn in during this time by virtue of the housing opening being opened. The crank angles consequently correspond to a position of the crankshaft and thus of the rotary disk valve at a certain point in time.

In the case of an opening angle of α=220° CA and a closing angle of β=80° CA and a transmission ratio of i=0.5, for example, this yields an angle range of the rotary disk valve opening of θ=55° for the rotary valve opening of the first rotary disk valve. Depending on requirements, the opening angle of the rotary valve opening of the first rotary disk valve may for example also lie in a range between 0° and 180°, in particular between 30° and 70°.

Here, the first rotary valve openings may be situated opposite one another and designed with point symmetry with respect to the axis of rotation of the first rotary disk valve. However, the rotary valve openings need not imperatively be situated opposite one another, and if required, may be formed in different angle ranges of the first rotary disk valve. The specification of two rotary valve openings is also not imperative, and this number may be increased if required.

Consequently, the first rotary valve openings of the first rotary disk valve, which is operatively connected in positively locking fashion to the rotatably mounted coupling shaft, can be placed in overlap with the inlet openings of the crankcase in a manner dependent on angle of rotation. The inlet openings of the crankcase are consequently completely closed, at least partially open or fully open depending on the angle of rotation of the first rotary disk valve.

In a further exemplary embodiment, on the coupling surface of the crankcase, there is provided a lubrication bore opening which is designed for introducing lubricant situated in the crankcase into the first rotary disk valve chamber. In particular, the lubrication bore opening may be designed to introduce lubricant situated in the crankcase into the first rotary disk valve chamber during the downward movement of the piston of the working cylinder.

Furthermore, the first rotary disk valve has at least one lubrication opening which is designed such that the at least one lubrication bore opening of the coupling surface of the crankcase is completely closed, partially open or fully open depending on the angle of rotation of the first rotary disk valve.

It is thus made possible for lubricants to be able to pass from the crankcase into the first rotary disk valve chamber as a function of the angle of rotation of the first rotary disk valve. It can thereby be ensured that a small part of the lubricant situated in the crankcase can be introduced into the rotary disk valve chamber, for example by means of the positive pressure generated in the housing by the downward movement of the piston of the working cylinder, by virtue of the lubrication bore opening of the crankcase being opened up by the lubrication opening of the first rotary disk valve at a certain angle of rotation of the first rotary disk valve.

This makes it possible for lubricant to be supplied to the rotating parts in the first rotary disk valve chamber without it being necessary for an additional, separate device, such as for example an oil atomizer, to be connected upstream. This would require more components and thus more installation space, and would furthermore additionally result in throttling losses. This solution consequently offers a simple and minimal-cost solution without additional components.

Furthermore, the first cover and the second cover may form a second rotary disk valve chamber. Here, the second rotary disk valve is arranged within the second rotary disk valve chamber and can be rotatably mounted by means of a plain bearing. The second rotary disk valve in this case has at least two second rotary valve openings which are designed such that they can be placed at least partially in overlap with the inlet openings of the crankcase by means of a rotational movement of the second rotary disk valve.

The second rotary disk valve may have a substantially circular circumference, and the rotary valve openings of the second rotary disk valve may be oriented concentrically and extend over a defined angle range. With regard to the definition of the angle range of the rotary valve openings of the second rotary disk valve, reference is made to the above statements regarding the rotary valve openings of the first rotary disk valve.

Furthermore, the second rotary valve openings of the second rotary disk valve may be situated opposite one another and designed with point symmetry with respect to the axis of rotation of the second rotary disk valve.

With regard to the angle range, the position and the number of openings of the second rotary disk valve, reference is made to the above statements regarding the openings of the first rotary disk valve.

Here, the second rotary disk valve may be designed such that, during a rotational movement of the second rotary disk valve, the inlet openings of the coupling surface of the crankcase, the first cover openings of the first cover and the second cover openings of the second cover are completely closed or partially open or fully open depending on the angle of rotation. Such an adjustment of the angle of rotation of the second rotary disk valve may in this case be performed manually or electromechanically, and independently of the angle of rotation of the first rotary disk valve.

In one embodiment, the second rotary disk valve has a stop device which extends radially from the outer circumference of the second rotary disk valve. Furthermore, on the second rotary disk valve chamber, there may be arranged a guide ring which can be mounted on the second cover, wherein the guide ring may be arranged rotatably, by plain bearing or rolling bearing means, on the second rotary disk valve chamber. The guide ring may have a receiving opening for receiving the stop device, wherein, owing to the stop device being received in the receiving opening, the guide ring is operatively connected to the second rotary disk valve and can be rotated by means of a manual or electromotive operating device for adjustment of the angle of rotation of the second rotary disk valve.

Effective and variable throttling of the supply of fresh air is achieved in this way. Consequently, the inlet opening of the crankcase is completely covered, partially covered or not covered at all by the second rotary disk valve depending on the angle of rotation of the second rotary disk valve.

Such adjustment and rotation of the guide ring and consequently of the second rotary disk valve may be performed by means of a cable pull arranged on the guide ring. Furthermore, it is also possible for the rotary disk valve to have a toothed contour and for the rotation of the guide ring to be performed by means of a gearwheel mechanism. It may be provided here that the second cover has at least one stop which can be placed in interaction with the stop device of the second rotary disk valve and which can consequently limit the rotational movement of the second rotary disk valve.

Furthermore, the second rotary disk valve may have idle bores which make it possible for a minimum supply of air to be admitted into the crankcase even when the inlet openings of the crankcase are closed by the second rotary disk valve.

Furthermore, the second cover may have an attachment device for the integration of a fuel pump.

In particular, the second rotary disk valve has a thickness from 0.5 to 5 mm, in particular of 1 mm. This makes it possible to realize control of the supply of air into the crankcase with extremely low outlay in terms of material and installation space.

The rotary disk valve arrangement described makes possible, with low outlay in terms of material and installation space, for the airflow into the crankcase to be controlled. By means of the movement of only one rotary disk valve (in this case of the second rotary disk valve), it is possible for the inlet openings of the crankcase for the supply of fresh air to be varied synchronously.

The rotary disk valve arrangement is suitable in particular for a supply of fresh air into a crankcase of a two-stroke internal combustion engine with direct injection and with working cylinders in a boxer arrangement. In addition to a two-cylinder boxer arrangement, it is also conceivable for four cylinders, six cylinders or more to be provided. The use of a rotary disk valve arrangement is not restricted to internal combustion engines with working cylinders in the boxer arrangement, and the rotary disk valve arrangement may for example also be used in the case of in-line engines.

The engine system may furthermore provide a fuel distributor block for an internal combustion engine.

The fuel distributor block for an internal combustion engine has a belt arrangement, wherein the belt arrangement comprises a belt, which is operatively connected to a belt pulley coupled to a shaft, for the purpose of driving an assembly, in particular an assembly of an engine, via a belt pulley which is operatively connected to the belt. Here, a belt diverting device for diverting the belt is arranged on the fuel distributor block in order to minimize the spatial extent of the belt arrangement.

Furthermore, the fuel distributor block may have a high-pressure inlet receptacle for receiving a feed device for highly pressurized fuel, a high-pressure outlet receptacle for receiving a discharge device for highly pressurized fuel, and a return receptacle for receiving a return device for the return of fuel. The high-pressure inlet receptacle, the high-pressure outlet receptacle and the return receptacle may respectively be composed for example of a bore in the fuel distributor block, said bores having a thread within the fuel distributor block, wherein the feed device, the discharge device and the return device may be composed of a connecting element, which can be connected in pressure-tight fashion to the high-pressure inlet receptacle, and an inlet line, outlet line and return line respectively connected in pressure-tight fashion to said connecting element.

Here, the highly pressurized fuel may be conducted via the feed device from a fuel pump into the fuel distributor block, and via the discharge device into, for example, injection valves of an internal combustion engine.

Furthermore, a pressure control valve for regulating the flow of fuel may be arranged on the fuel distributor block.

Here, the fuel distributor block may have a high-pressure-side line and a low-pressure-side line for fuel, wherein the lines are coupled to one another via the pressure control valve, and wherein the pressure control valve may have a seal for separating the low-pressure-side line from the high-pressure-side line.

Alternatively or in addition, a pressure sensor for measuring the fuel pressure of the highly pressurized fuel may be coupled to the high-pressure-side line of the fuel distributor block.

Furthermore, the return device is connected to the low-pressure-side line in order for the fuel that has been conducted from the high-pressure-side line into the low-pressure-side line via the pressure control valve to be conducted into the return line. Here, the return line may for example be connected to a fuel pump or to a fuel accumulator vessel.

The fuel pressure in the high-pressure-side line may be up to 200 bar, in particular 120 bar, wherein the fuel pressure in the low-pressure-side line is preferably between 2 and 4 bar.

The fuel distributor block may be designed to conduct fuel to the injection valves or into a return line. The integration of the individual elements mentioned above permits control of the fuel flow by means of a simple arrangement which saves installation space and weight.

In one exemplary embodiment, the belt is operatively connected to a first belt pulley and to a second belt pulley and can be diverted by the belt diverting device in an angle range defined by an angle between the axis of rotation of the first belt pulley and the axis of rotation of the second belt pulley, wherein the angle range encompasses angles from 10° to 170°, in particular an angle of substantially 90°. Here, a toothed belt, flat belt or V-belt, for example, may be provided as a belt. This means substantially that the angle may deviate within the usual manufacturing tolerances.

Furthermore, the belt diverting device may have at least two diverting elements which are arranged by means of connecting elements on the fuel distributor block, wherein the axes of the connecting elements enclose an angle of less than or equal to 180°, and the angle extends in the direction of the plane in which the circumferential surface of the first belt pulley lies. Alternatively or in addition, the axes of the connecting elements may enclose an angle of less than or equal to 180°, and the angle extends away from the plane in which the circumferential surface of the second belt pulley lies.

An arrangement of said type allows the toothed belt to run over the diverting device with minimal wear, and permits smooth operation.

Here, the diverting elements may be oriented rigidly about the connecting elements, and a diversion may for example be realized over a simple cylindrical shape which is for example wetted with lubricant. Alternatively, the diverting elements may also be mounted so as to be rotatable about the connecting elements, which are for example in the form of bearing journals. Furthermore, the diverting elements may also have guide devices for a V-belt or toothed belt into which guide devices the geometric structure of the belts can engage.

In an alternative embodiment, the at least two diverting elements of the belt diverting device are arranged at an angle of 90° on a base surface of the fuel distributor block by means of connecting elements, wherein the base surface narrows in the direction of the plane in which the circumferential surface of the first belt pulley lies. Alternatively or in addition, the base surface may narrow away from the plane in which the circumferential surface of the second belt pulley lies.

In a further exemplary embodiment, a pulsation damper may be provided on the fuel distributor block, which pulsation damper is designed to dampen pressure oscillations in the fuel line system.

In an alternative embodiment, the crankcase is composed of two structurally identical parts which can be produced by means of casting and which, by being rotated through 180°, can be assembled to form a housing. A considerable reduction in costs during production is realized in this way. It is alternatively also possible for more than two structurally identical parts to be assembled to form a crankcase.

The fuel distributor block is suitable in particular for a compression of fuel to high pressure for a two-stroke internal combustion engine with direct injection and with working cylinders in a boxer arrangement. In addition to a two-cylinder boxer arrangement, it is also conceivable for four cylinders, six cylinders or more to be provided. The use of the fuel distributor block is not restricted to internal combustion engines with working cylinders in the boxer arrangement, and the fuel distributor block may for example also be used in the case of in-line engines.

The engine system according to an exemplary embodiment of the invention may furthermore have a rotary disk valve arrangement and/or a fuel distributor block with the features described above. The solution according to the invention permits an improvement in the scavenging efficiency of the internal combustion engine while simultaneously yielding considerable weight and installation space advantages, and a low burden on the material of the of the engine system, in relation to known internal combustion engines with the same performance.

The engine system according to the invention is suitable in particular for a two-stroke internal combustion engine with direct injection and with working cylinders in a boxer arrangement. Alternatively, the two-stroke internal combustion engine may, on the basis of a modular concept, be expanded in a simple manner to four, six, eight or more cylinders.

The use of the engine system is not restricted to internal combustion engines with working cylinders in the boxer arrangement, and the fuel distributor block may for example also be used in the case of in-line engines.

BRIEF DESCRIPTION OF THE DRAWINGS

The invention will be explained in more detail below on the basis of exemplary embodiments and with reference to the figures.

DETAILED DESCRIPTION

Figure 1:
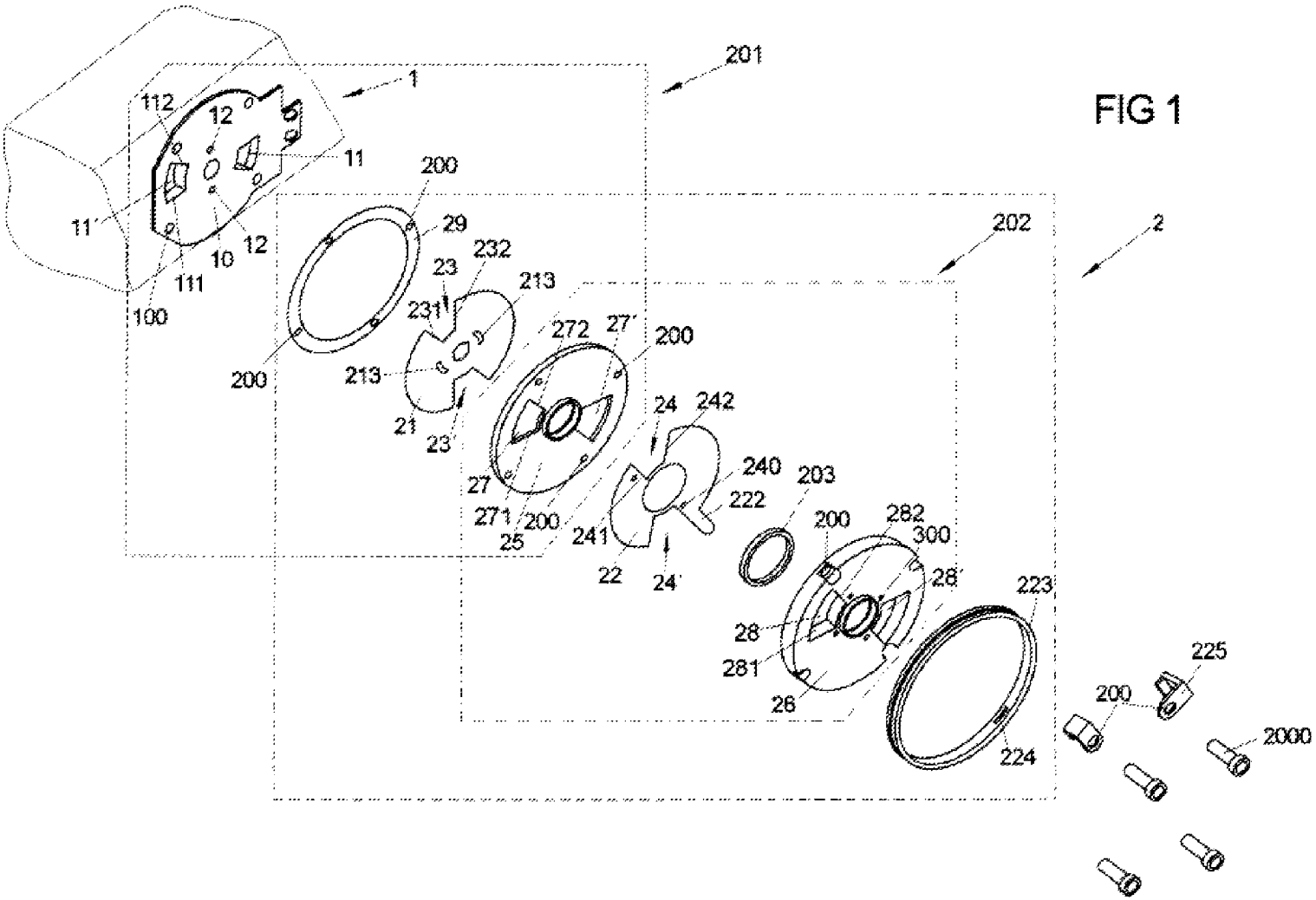
FIG. 1 shows a first exemplary embodiment of a rotary disk valve arrangement for regulating the supply of fresh air in a crankcase.

FIG. 1 shows in detail the main parts required for a rotary disk valve arrangement 2. Indicated in the illustration is a section of the crankcase 1 which, on the inlet side of the coupling surface 10, has two inlet openings 11, 11' which are situated in the range of rotation of a first rotary disk valve 21. Here, the inlet openings 11, 11' are of circular-segment-shaped form, wherein the inlet openings 11, 11', have side edges 111, 112 which extend radially from the central point of the coupling surface 10. The coupling surface 10 is in this case of substantially circular form. Here, "substantially" means that the coupling surface 10 may also have flattened segments on the circumference of the circle, or may have geometric elements, such as for example a rectangle, arranged on the circumference of the circle. The coupling surface 10 need not imperatively be configured substantially as a circular surface, and may also be modified if required. A rectangular shape of the coupling surface is also possible, for example.

The two inlet openings 11, 11' of the coupling surface 10 of the crankcase 1 are situated opposite one another, and in this case are designed with point symmetry with respect to the axis of rotation of the crankshaft of the crankcase 1. The fact that the coupling surface has two identical inlet openings 11, 11' situated opposite one another is merely by way of example. Inlet openings of different shapes and with different opening areas are also conceivable. Furthermore, the embodiment is not restricted to two inlet openings, wherein three or more inlet openings are also conceivable, said inlet openings being arranged in each case at identical angular intervals with respect to one another. An arrangement of different inlet openings at different angular intervals with respect to one another is likewise possible.

In this case, the crankcase 1 has, on the coupling surface 10, receiving devices 100 for the fastening of the rotary disk valve arrangement 2. A first cover 25 can be fastened to the coupling surface 10, by way of the receiving device 100 of the coupling surface 10 and by way of the fastening opening 200, by means of connecting elements 2000, wherein the fastening opening 200 is arranged on the first cover 25. Here, the coupling surface 10 and the first cover 25 form a first rotary disk valve chamber 201. The fastening may be realized for example by means of screws, rivets, welding or the like.

Furthermore, a seal 29 is arranged between the coupling surface 10 and the first cover 25. The seal 29 likewise has fastening opening 200 by means of which the seal 29 can be attached, as explained, to the receiving devices 100 of the coupling surface 10.

The seal 29 is designed so as to prevent an escape of air from the crankcase. A positive pressure is generated in the crankcase 1 in particular during the downward movement of the piston in the working cylinder (not illustrated here), which positive pressure pushes the first rotary disk valve 21 away from the coupling surface 10 toward the cover 25 of the first rotary disk valve chamber 201. In this case, the seal 29 prevents an escape of the air and can thus minimize a drop in the scavenging pressure.

The first rotary disk valve 21 is arranged within the first rotary disk valve chamber 201. In this case, the first rotary disk valve 21 is operatively connected in positively locking fashion to a cranked coupling shaft (not illustrated) and is rotatably mounted. Here, the cranked coupling shaft is connected by means of a gearing (not illustrated here) to the crankshaft arranged in the crankcase 1, such that the cranked coupling shaft rotates at a lower rotational speed than the crankshaft. In particular, the cranked coupling shaft is connected by means of a gearing to the crankshaft such that the cranked coupling shaft rotates at half of the rotational speed of the crankshaft.

Here, the first rotary disk valve 21 has at least two first rotary valve openings 23, 23' which are designed such that they can be placed in overlap with the inlet openings 11, 11' of the crankcase 1 by means of a rotational movement of the first rotary disk valve 21.

Here, the first rotary valve openings 23, 23' are of circular-segment-shaped form and are oriented concentrically with respect to the center of symmetry of the first rotary disk valve 21. The first rotary valve openings 23, 23' extend in this case over an angle range of 55°, wherein the side edges 231, 232, 231', 232' of the first rotary valve openings 23, 23' extend radially from the central point of the circular first rotary disk valve. The angle range is not restricted to these specifications and may be adapted if required, as already described.

The side edges 231, 232, 231', 232' are in this case arranged parallel to the side edges 111, 112, 111', 112' of the inlet openings 11, 11' of the coupling surface 10 of the crankcase 1. The first rotary valve openings 23, 23' are situated opposite one another and are designed with point symmetry with respect to the axis of rotation of the first rotary disk valve 21.

The position of the first rotary valve openings 23, 23' consequently corresponds to the position of the inlet opening 11, 11' of the coupling surface 10 of the crankcase 1. In this case, the angular interval of the first rotary valve openings 23, 23' corresponds to the angular interval of the inlet openings 11, 11'. The angular interval of the first rotary valve openings 23, 23' may alternatively also be greater than or less than the angular interval of the inlet openings 11, 11' of the crankcase 1.

The configuration of the first rotary valve openings 23, 23' is merely an example. With regard to the configuration of the position of the first rotary valve openings 23, 23', it is essential that these substantially correspond to the position and configuration of the inlet openings 11, 11' of the coupling surface 10 of the crankcase 1. With regard to a variance of the configuration, the positioning and the number of the first rotary valve openings 23, 23', reference is made to the statements given above. Here, it is obvious to a person skilled in the art that, in the event of a corresponding modification of the inlet openings 11, 11', the first rotary valve openings 23, 23' of the first rotary disk valve 21 should also be varied correspondingly.

Furthermore, the first cover 25 of the first rotary disk valve chamber 201 has two first cover openings 27, 27', wherein the first cover openings 27, 27' can be placed in overlap with the inlet openings 11, 11' of the crankcase 1 when the first cover 25 is attached to the coupling surface 10. Here, the first cover openings 27, 27' are substantially identical, in terms of shape, dimensions and positioning, to the inlet openings 11, 11'. The first cover 25 likewise has fastening openings 200 by means of which the first cover 25 can be attached to the receiving devices 100 of the coupling surface 10, as already explained.

In the exemplary embodiment of FIG. 1, the first cover openings 27, 27' of the first cover 25 are likewise of circular-segment-shaped form, wherein the side edges 271, 272, 271', 272' of the first cover openings 27, 27' likewise extend radially from the central point of the substantially circular first cover 25. The first cover openings 27, 27' are in this case designed with point symmetry with respect to the axis of rotation of the first rotary disk valve 21, and the angular interval of the side edges 271 and 272, and 271' and 272' respectively, corresponds to the angular interval of the side edges 111 and 112, and 111' and 112' respectively, of the inlet opening 11, 11' of the coupling surface 10 of the crankcase 1.

The shape and positioning of the first cover openings 27, 27' of the first cover 25 may alternatively also differ from those of the inlet openings 11, 11' of the coupling surface 10 of the crankcase 1. Here, it is crucial merely that the inlet openings 11, 11' can be placed at least partially in overlap with the first cover openings 27, 27' of the first cover 25.

As already described, the first rotary disk valve 21 is operatively connected to the crankshaft of the crankcase 1, and rotatably mounted, by means of a cranked coupling shaft. During a rotation of the first rotary disk valve 21, the first rotary valve openings 23, 23', during the rotational movement of the first rotary disk valve 21, pass over the inlet openings 11, 11' at regular intervals. Consequently, the inlet openings 11, 11' are completely closed, partially open or fully open depending on the angle of rotation of the first rotary disk valve 21.

Furthermore, the crankcase 1 has lubrication bore openings 12 on the coupling surface 10. Via the lubrication bore openings 12, lubricant that may be situated in the crankcase is introduced into the first rotary disk valve chamber 201 during a downward movement of the piston of the working cylinder (not illustrated here). In this case, the first rotary disk valve 21 has two lubrication bore openings 213 which are designed such that the lubrication bore openings 12 of the crankcase 1 are completely closed, partially open or fully open depending on the angle of rotation of the rotary disk valve 21.

Here, the positions of the lubrication bore openings 12 of the crankcase 1 and of the lubrication openings 213 of the first rotary disk valve 21 are selected such that, during a rotational movement of the first rotary disk valve 21, the lubrication opening 213 of the first rotary disk valve 21 passes over the lubrication opening 12 of the crankcase 1 when the piston of the working cylinder is performing a downward movement. A passage to the first rotary disk valve chamber 201 is thus opened up during the downward movement.

In the exemplary embodiment of FIG. 1, the lubrication openings 213 are arranged at an angular interval of 90° from the axis of symmetry of the first rotary valve openings 23, 23' of the first rotary disk valve 22, and/or the lubrication bore openings 12 are arranged at an angular interval of approximately 90° from the axis of symmetry of the inlet openings 11, 11' of the coupling surface 10 of the crankcase 1.

In this case, the lubrication openings 213 have a larger opening area than the lubrication bore opening 12. The positions and configurations of the lubrication bore openings 12 and of the lubrication openings 211 are merely exemplary and may be adapted as required.

The lubrication opening 213 makes it possible, for a defined range of angle of rotation, for the lubrication bore opening 12 in the crankcase 1 to be opened up, in a manner dependent on angle of rotation, precisely within the downward movement of the piston of the working cylinder. The range of angle of rotation is 60° in the exemplary embodiment of FIG. 1.

A greater or smaller range of angle of rotation may alternatively also be used as required. It is ensured in this way that, under the action of the positive pressure that prevails in the crankcase 1 in said phase, a small amount of the lubricant situated in said crankcase can pass into the first rotary disk valve chamber 201. By means of the lubricant thus admitted into the first rotary disk valve chamber 201, the first rotary disk valve 21 is wetted with lubricant. The lubricant droplets thus situated on the rotating rotary disk valve 21 are distributed on the first rotary disk valve 21 owing to centrifugal forces, and ensure the lubrication of said first rotary disk valve and thus reduce the wear thereof and consequently increase the operational durability of the first rotary disk valve 21.

Consequently, no separate devices are required for transporting lubricant into the first rotary disk valve chamber 201. Additional devices require more components, more installation space and entail additional throttling losses, such that the arrangement is characterized by a simple production method, with minimal costs and without additional components.

Furthermore, a second cover 26 can be connected via a fastening opening 200 to the first cover 25, as already described, such that the first cover 25 and the second cover 26 form a second rotary disk valve chamber 202. A second rotary disk valve 22 is arranged, and rotatably mounted by means of a plain bearing 203, within the rotary disk valve chamber 202.

Here, the second cover 26 has two second cover openings 28, 28' which are designed such that they can be placed in overlap with the first cover openings 27, 27' of the first cover 25 and with the inlet openings 11, 11'. The second cover openings 28, 28' are of circular-segment-shaped form, and the side edges 281, 282, 281', 282' of the second cover openings 28, 28' extend radially from the central point of the substantially circular second cover 26. The angular interval of the second cover openings 28, 28' of the second cover 26 corresponds to 60°, and is consequently greater than the angular interval of the first cover openings 27, 27' of the first cover 25 and of the inlet openings 11, 11' of the coupling surface 10 of the crankcase 1. The angular interval of the second cover openings 28, 28' may alternatively also be identical to the angular interval of the first cover openings 27, 27' and/or of the inlet openings 11, 11', or smaller than the angular interval of said openings. Here, the second cover openings 28, 28' are designed with point symmetry with respect to the axis of rotation of the second rotary disk valve 22.

It must be noted here that the angular interval is variable. The same prerequisites as those for the already-described angular interval of the first rotary disk valve also apply with regard to the angular interval of the cover openings. For further explanations, reference is made to the statements already made above.

Furthermore, the second rotary disk valve 22 mounted rotatably within the second rotary disk valve chamber 202 has two second rotary valve openings 24, 24' which are oriented concentrically and which extend over an angle range of 55° between the side edges 241, 242, 241', 242'. Furthermore, the side edges 241, 242, 241', 242' of the second rotary valve openings 24, 24' extend radially from the central point of the substantially circular second rotary disk valve 22, and the second rotary valve openings 24, 24' are designed with point symmetry with respect to the axis of rotation of the second rotary disk valve 22.

It must be noted here that the angular interval is variable. The same prerequisites as those for the already-described angular interval of the first rotary disk valve also apply with regard to the angular interval of the cover openings. For further explanations, reference is made to the statements already made above.

With regard to a variance of the position, the shape or the dimensions of the second rotary valve openings 24, 24' of the second rotary disk valve 22, reference is made to the explanations given above regarding the first rotary disk valve 21.

The second rotary disk valve 22 can consequently completely close, partially open or fully open the first and second cover openings 28, 28' and 27, 27' respectively, and consequently also the inlet openings 11, 11', depending on the angle of rotation. Here, the angle of rotation of the second rotary disk valve 22 may be adjusted manually or electromechanically.

In the embodiment of FIG. 1, the second rotary disk valve 22 has a stop device 222 which extends radially from the outer circumference of the rotary disk valve 22. On the second rotary disk valve chamber 202 there is arranged a guide ring 223 which is mounted in plain bearing fashion, and rotatably arranged, on the second rotary disk valve chamber 202 by means of guide tabs 225. Mounting of the guide ring 223 by rolling bearing means is likewise conceivable.

Here, the guide ring 223 is arranged on the second rotary disk valve chamber 202 by means of guide tabs 225 which can be attached by way of the fastening opening 200 to the second cover 26. Furthermore, the guide ring 223 has a receiving opening 224 in which the stop device 222 is received, and the guide ring 223 is thus operatively connected to the second rotary disk valve 22 by way of the stop device 222. It is thereby ensured that a setting of the angle of rotation of the second rotary disk valve 22 can be adjusted by means of a manual or electromotive operating device (not illustrated here) which is coupled to the guide ring 223.

A rotation of the guide ring 223 and thus a rotational movement of the second rotary disk valve 22 may for example be performed by means of a cable pull arranged on the guide ring 223. It is also conceivable for the outer circumference of the second rotary disk valve 22 to have a toothed contour is and for the rotation of the guide ring 223 and thus the rotation of the second rotary disk valve 22 to be performed by way of a gearwheel mechanism.

Furthermore, the second cover 24 has stops 230 (illustrated in FIG. 2) which interact with the stop device 222 of the second rotary disk valve 22. Consequently, the rotational movement of the second rotary disk valve 22 can be limited by the stops 230. In the embodiment of FIG. 1, the second rotary disk valve 22 has idle bores 240 which make it possible for a minimum supply of air to be admitted into the crankcase 1 when the second cover opening 28, 28' is closed by the second rotary disk valve 22. Here, the idle bores 240 are formed in the second rotary disk valve 22 such that, when the second rotary disk valve 22 is in a completely closed state, said idle bores are in overlap with the first and second cover openings 27, 27' and 28, 28'.

The second rotary disk valve 22 of the exemplary embodiment of FIG. 1 has a thickness of 1 mm. The arrangement is consequently characterized in that a stable and functionally reliable device for the variable throttling of the supply of fresh air into the crankcase can be realized with the smallest possible installation space, the fewest possible components and the least possible outlay in terms of production. It is consequently possible for the flow cross section of the two inlet openings 11, 11' of the coupling surface 10 of the crankcase 1 to be varied synchronously through movement of the second rotary disk valve.

Furthermore, the second cover 26 also has an attachment device 300 by means of which a fuel pump can be connected via a pump housing to the rotary disk valve arrangement 2. A connection may be realized for example by means of screw connection. It is alternatively possible for the second cover 26, and the pump housing (not illustrated here) of a fuel pump, to be formed as one cast part, thus further reducing the number of parts.

In this case, the coupling surface 10 has a fastening receptacle 100, for example a bore with a thread. Furthermore, the seal 29, the first cover 25, the second cover 26 and the guide rails 225 have a fastening opening 200 via which the individual elements mentioned above can be connected to one another, and fastened to the coupling surface, by means of a fastening element 2000, such as for example a screw.

Figure 2:
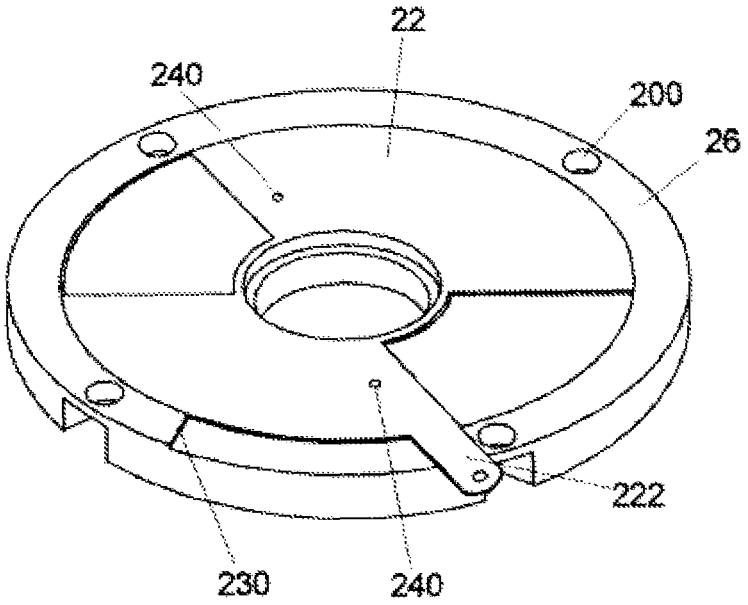
FIG. 2 shows a detail view of the first exemplary embodiment of the rotary disk valve arrangement of FIG. 1.

FIG. 2 illustrates a detail view from the rear of the rotary disk valve arrangement 2 composed of the second rotary disk valve 22 and the second cover 26. The second rotary disk valve 22 is situated in a position in which the second cover opening 28, 28' (not visible here) of the second cover 26 is completely closed. The figure clearly shows a stop edge 230 for the interaction with the stop device 222 (the second stop edge is concealed by the stop device 222). Consequently, the second rotary disk valve 22 can move rotationally only between the stop edges 230.

Furthermore, the idle bores 240 within the second rotary disk valve 22 and the fastening openings 200 can be clearly seen. The idle bores serve for a minimum supply of fresh air into the crankcase 1 even when the second cover opening 28, 28' of the second cover 26 is completely closed by the second rotary disk valve 22. For further explanations, reference is made to the statements given above.

Figure 3A:
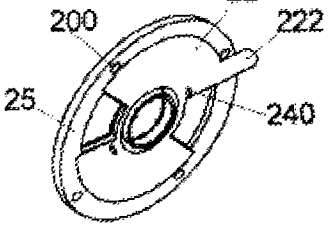
FIG. 3A shows a detail view of the first exemplary embodiment of the rotary disk valve arrangement of FIG. 1, wherein the angle of rotation of the second rotary disk valve and the angle of rotation of the first rotary disk valve correspond to a fully open state.
Figure 3B:
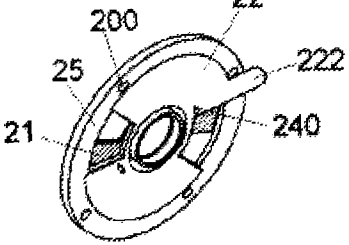
FIG. 3B shows an exemplary embodiment of the arrangement as per FIG. 3A, wherein the angle of rotation of the second rotary disk valve corresponds to a fully open state and the angle of rotation of the first rotary disk valve corresponds to a half-open state of the inlet opening of the crankcase.
Figure 3C:
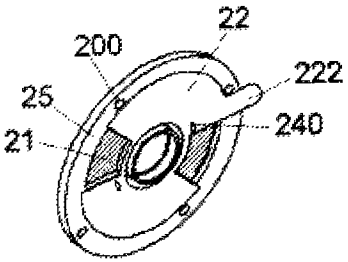
FIG. 3C shows a further exemplary embodiment of the arrangement as per FIG. 3A, wherein the angle of rotation of the second rotary disk valve corresponds to a fully open state and the angle of rotation of the first rotary disk valve corresponds to a complete closure of the inlet opening of the crankcase.

FIGS. 3*a*-3*c* show snapshots of the individual positions, dependent on angle of rotation, of the first rotary disk valve 21 and of the second rotary disk valve 22. Said snapshots serve to give an improved understanding of the operating principle of the rotary disk valve arrangement 2. Here, the illustration shows a partial arrangement composed of the first rotary disk valve 21, the first cover opening 25 and the second rotary disk valve 22.

In FIGS. 3*a*-3*c*, the second rotary disk valve 22 is in a completely open state, such that the second cover openings 28, 28' of the second cover 26 (neither of which are illustrated here) are fully opened up for a supply of fresh air. In FIG. 3*a*, the first rotary disk valve 21 is situated at an angle of rotation at which the first rotary valve openings 23, 23' are in overlap with the inlet openings 11, 11' of the crankcase 1 and with the first and second cover openings 27, 27' and 28, 28'. A maximum passage of fresh air is thus possible.

FIG. 3*b* shows a snapshot in which the first rotary disk valve 22 has moved further in the direction of rotation of the crankshaft 5 (not illustrated here). The position of the second rotary disk valve 22 remains in the fully open state. As a result of the rotational movement of the first rotary disk valve 21, the first rotary valve openings 23, 23' of the first rotary disk valve 21 and the openings 11, 11', 27, 27', 28, 28' are only partially still in overlap. In the exemplary embodiment of FIG. 3*b*, only half of the cross section of the inlet openings 11, 11' is available for the supply of fresh air.

In the exemplary embodiment of FIG. 3*c*, the position of the second rotary disk valve 22 remains unchanged. As a result of the rotational movement in the direction of rotation of the crankshaft 5, the first rotary disk valve 21 has moved in rotation such that its first rotary valve openings 23, 23' are no longer in overlap with the openings 11, 11', 27, 27', 28, 28'. Consequently, the inlet opening 11, 11' is closed by the rotary disk valve 21, and the supply of fresh air into the crankcase 1 is blocked.

Figure 4A:
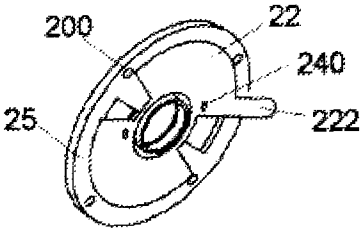
FIG. 4A shows a detail view of the first exemplary embodiment of the rotary disk valve arrangement of FIG. 1, wherein the angle of rotation of the first rotary disk valve corresponds to a fully open state and the angle of rotation of the second rotary disk valve corresponds to a state of 75% closure.
Figure 4B:
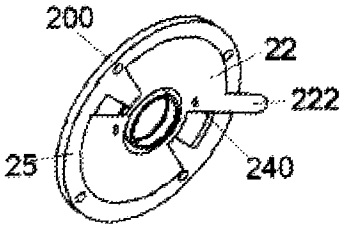
FIG. 4B shows an exemplary embodiment of the arrangement as per FIG. 4A, wherein the angle of rotation of the first rotary disk valve corresponds to a state of 50% closure of the opening of the crankcase.
Figure 4C:
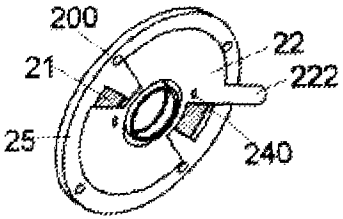
FIG. 4C shows a further exemplary embodiment of the arrangement as per FIG. 4A, wherein the angle of rotation of the first rotary disk valve corresponds to a fully open state of the opening of the crankcase.

FIGS. 4*a*-4*c* show snapshots similar to FIGS. 3*a*-3*c*, but in this case the second rotary disk valve 22 has been rotated so as to cover approximately 75% of the openings 11, 11', 27, 27' and 28, 28'.

In the exemplary embodiment of FIG. 4*a*, the first rotary disk valve is in a position similar to that in FIG. 3*a*. The first rotary valve openings 23, 23' of the first rotary disk valve 21 are in overlap with the openings 11, 11', 27, 27', 28, 28'. The inlet cross section available for the fresh air is consequently restricted by 75% owing to the position of the second rotary disk valve 22.

FIG. 4*b* shows the second rotary disk valve 22 in the same position as in FIG. 4*a*. The first rotary disk valve 21 is, as a result of a rotational movement, situated in the same position as in FIG. 3*b*. Consequently, the cross section for the ingress of fresh air remains restricted owing to the position of the second rotary disk valve 22.

In FIG. 4*c*, the position of the second rotary disk valve 22 remains unchanged. The first rotary disk valve 21 is situated, similarly to FIG. 3*c*, in a completely closed position. Consequently, the supply of fresh air is blocked owing to the position of the first rotary disk valve 21.

FIGS. 3*a*-3*c* and 4*a*-4*c* show merely individual snapshots of certain positions of the rotary disk valve arrangement 2, and serve to give an improved understanding.

The second rotary disk valve 22 may self-evidently also be adapted in continuously variable fashion, by means of an operating device, to the respective requirements for a supply of fresh air into the crankcase 1. This means, for example, that the position of the second rotary disk valve 22 can be variably adjusted as the first rotary disk valve 21 rotates, and thus a larger or smaller cross section for the ingress of fresh air can be provided as required.

Figure 5:
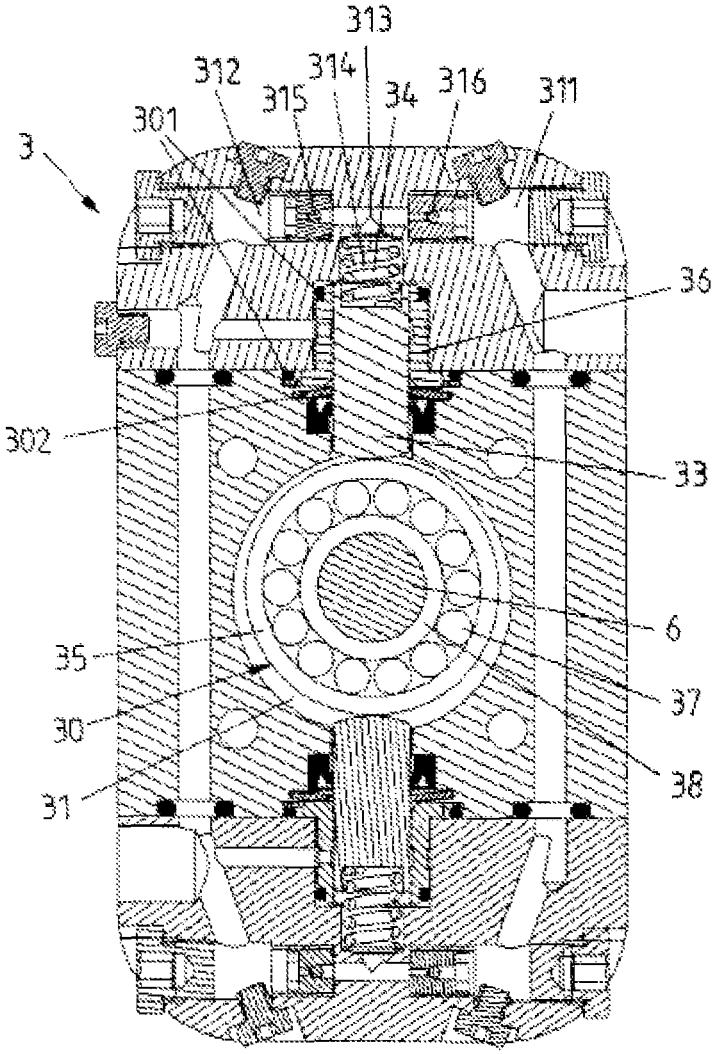
FIG. 5 shows an exemplary embodiment of a fuel pump in cross section.

The exemplary embodiment of FIG. 5 shows a fuel pump 3. The fuel pump 3 has a fuel inflow duct 312 on the low-pressure side and a fuel outflow duct 311 on the high-pressure side. The fuel passes via the fuel inflow duct 312 and via inflow and outflow bores 313 into the pump chamber 314. There, the fuel is compressed and passes via the inflow and outflow bores into the fuel outflow duct of the high-pressure side 312. Here, the ducts of the high-pressure side and low-pressure side each have check valves 315 and 316.

The fuel pump 3 has two mutually opposite compression pistons 33. The compression pistons 33 are in this case arranged around an outer rolling ring 35 which is connected to the cranked coupling shaft 6 and which is seated on the cranked portion and which is arranged in a rolling bearing chamber 31. Under the action of a preloaded spring 34, the compression pistons 33 bear by way of their radially inner ends against the outer circumferential surface of the outer rolling ring 35, and are guided in an axially displaceable fashion in a respective cylinder liner 36. Here, the rolling bearing chamber 31 is at least partially filled with lubricant.

By means of the at least partial filling of the rolling bearing chamber 31 with lubricant, it is ensured that the moving parts in the rolling bearing chamber, such as the outer circumferential surface of the outer rolling ring 35 or the lower ends of the compression pistons 33, exhibit low material wear, and consequently the service life of the individual components is considerably lengthened.

Furthermore, the transmission of force from the cranked coupling shaft 6 to the outer circumferential surface of the outer rolling ring 35 is performed via rolling bearings 37 arranged between the outer rolling ring 35 and the inner rolling ring 38 of the rolling bearing 30. The rolling bearing 30 makes it possible, over the entire rotational speed range of the fuel pump 3 but in particular at low rotational speeds, for considerably lower circumferential forces to be exerted on the outer circumferential surface of the outer rolling ring 35 than is possible with plain bearings. In this way, firstly, the shear forces acting on the compression pistons 33 are further minimized, and secondly, wear phenomena such as would arise owing to sliding friction between the compression pistons 33 and outer circumferential surface of the outer rolling ring 35 are eliminated. This yields a good transmission of force while simultaneously ensuring material preservation. Furthermore, it is possible to eliminate the need for accommodating separate sliding elements, such as are required in the case of solutions based on the sliding friction in order to achieve corresponding wear resistance. The outlay in terms of manufacture and the number of parts required are thus reduced.

Figure 6:
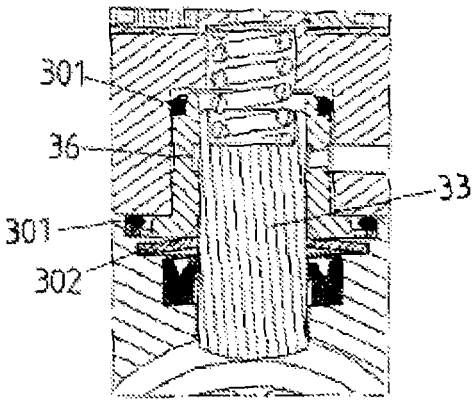
FIG. 6 shows an enlarged detail of the cylinder liner of the fuel pump as per FIG. 5.

The exemplary embodiment of FIG. 6 shows an enlarged detail of the cylinder liner 36 of the fuel pump 3 of FIG. 5. Here, the cylinder liner 36 of the compression piston 33 is mounted with radially elastic action. Here, the radially elastic mounting is realized by means of elastomer rings 301. Furthermore, axially elastic mounting of the cylinder liner 36 of the compression piston 33 is provided in the exemplary embodiment. This is realized here by means of a plate spring 302.

By means of the described type of mounting, elastic flexibility of the cylinder liner position is attained, which considerably reduces the edge loads between cylinder liner 36 and compression piston 33. The edge loads arise owing to the shear forces that act on the compression pistons 33 during operation. In the case of a rigid mounting, tilting of the compression piston 33 within the cylinder liner 36 occurs, with the result that the compression piston 33 is supported only against the ends of the cylinder liner 36. At these points, in the case of a rigid mounting, a disadvantageous load distribution arises at the liner edges, which load distribution has the effect of increasing wear both of the piston and also of the cylinder liner material. The elastic flexibility of the cylinder liner mounting reduces this disadvantageous effect to a minimum, and permits considerably reduced wear and higher rotational speeds of the fuel pump 3.

Figure 7:
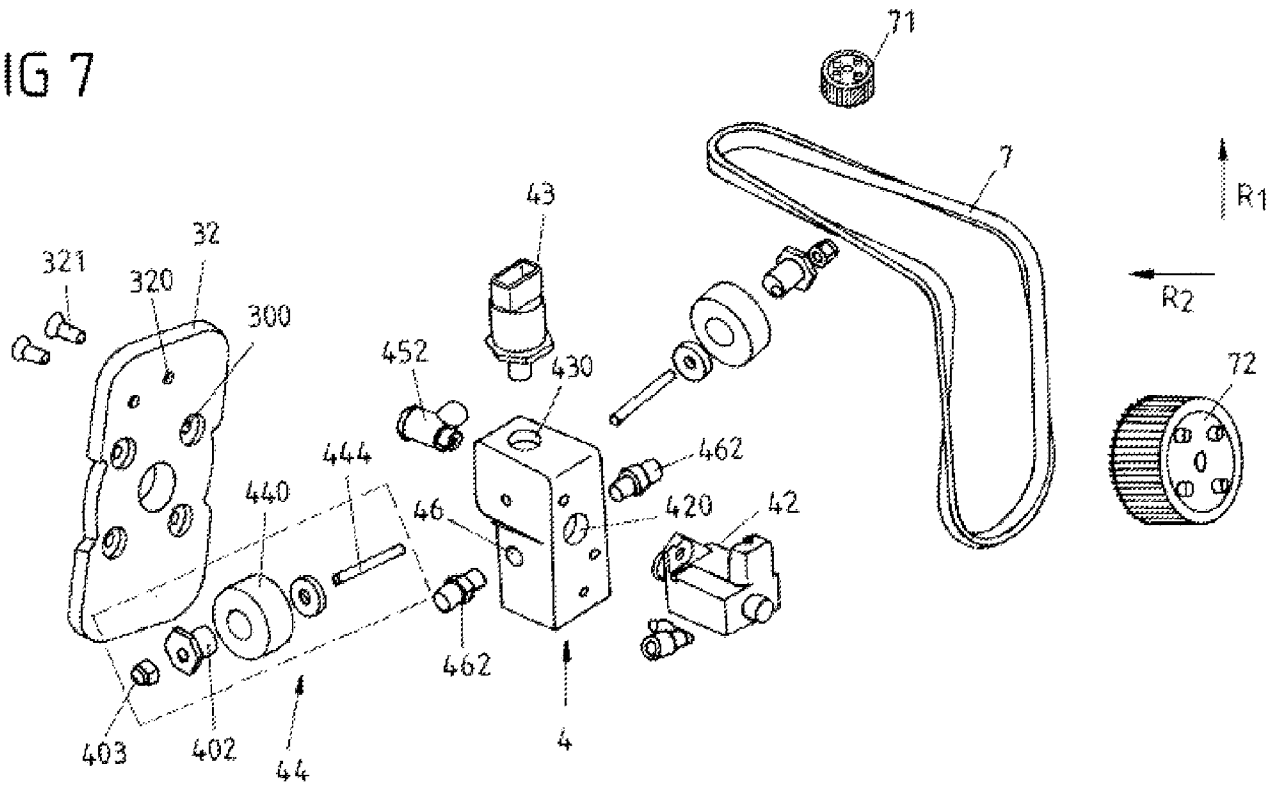
FIG. 7 shows an exemplary embodiment of a fuel distributor block.
Figure 8:
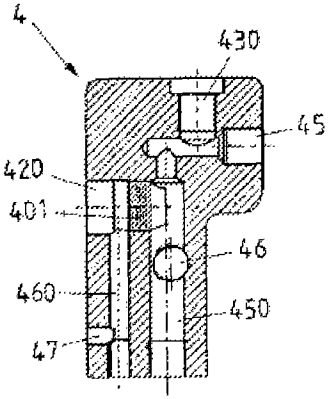
FIG. 8 shows the exemplary embodiment of the fuel distributor block as per FIG. 7 in cross section.

The exemplary embodiment of FIG. 7 shows a fuel distributor block 4 of an internal combustion engine, and the exemplary embodiment of FIG. 8 shows a cross section through a fuel distributor block. The exemplary embodiment of FIG. 7 and FIG. 8 concerns a multifunctional fuel distributor block 4 which a high-pressure inlet receptacle 45 for receiving a connecting element 45 of a feed device for highly pressurized fuel, for the purpose of conducting fuel from a fuel pump into the fuel distributor block, a high-pressure outlet receptacle 46, not illustrated here owing to the perspective, for receiving a connecting element 462 of a discharge device for highly pressurized fuel, for the purpose of conducting fuel into injection valves (not illustrated), and a return receptacle 47 for receiving a connecting element of a return device (not illustrated here), for the purpose of conducting excess fuel into the return line. The connecting elements may for example be composed of high-pressure-resistant screw-in adapters, and connected in a pressure-tight manner to a line.

Furthermore, electrically regulated pressure control valves 42 and pressure sensors 43, which serve for the regulation of the fuel distribution, in the fuel distributor block are integrated into the corresponding receiving devices 420, 430. Also provided is a pulsation damper for damping pressure oscillations in the fuel line system, said pulsation damper however not being illustrated here for reasons of clarity.

Here, a belt diverting device 44 for diverting a belt 7 is arranged on the fuel distributor block 4. In this case, the belt 7 is operatively connected to a belt pulley 71, which is coupled to a shaft (not illustrated). Here, a coupling shaft (not illustrated here), for example, is driven by means of a further belt pulley 72 which is operatively connected to the belt.

The belt 7, in this case a toothed belt, is diverted by the belt diverting device 44 through an angle of 90°, said angle being defined by the angle between the axis of rotation of the first belt pulley 71 and the axis of rotation of the second belt pulley 72.

Here, the belt diverting device 44 has at least two diverting elements 440, in this case diverting rolling bearings, which, by means of connecting elements 444, in this case bearing shafts, are arranged on a base surface 400 of the fuel distributor block 4 at an angle of 90°. Furthermore, an eccentric sleeve 403 is attached to the diverting device 44, which eccentric sleeve permits preloading of the belt 7.

The base surface 400 narrows in the direction R1 of the plane in which the circumferential surface of the first belt pulley 71 lies. Furthermore, the base surface narrows in a direction R2 away from the plane in which the circumferential surface of the second belt pulley 72 lies. In this case, the narrowing angle $\alpha$ is identical in the directions R1 and R2 and is dependent on the transmission ratio of the first and second belt pulleys 71, 72, as will be explained in the following FIGS. 9 to 11.

An arrangement of said type allows the toothed belt to run over the diverting device with minimal wear, and permits smooth operation.

The fuel distributor block 4 has a high-pressure-side line 450 which issues into the high-pressure inlet receptacle 45. On the high-pressure inlet receptacle 45 there is arranged a feed device (not illustrated here) for highly pressurized fuel, for the purpose of conducting fuel from a fuel pump into the fuel distributor block; in this case, a connecting element of a feed device 452 (in this case a high-pressure-resistant screw-in adapter) is connected in a pressure-tight manner to the high-pressure inlet receptacle 45. Also attached is a pressure sensor for measuring the fuel pressure within the high-pressure-side line 450, said pressure sensor being arranged on the fuel distributor via a pressure sensor receptacle.

Furthermore, on the high-pressure-side line 450, a high-pressure outlet receptacle 46 is connected in dimensionally rigid fashion to a connecting element of a discharge device 462, in this case a high-pressure-resistant screw-in adapter, for the purpose of conducting highly pressurized fuel into the injection valves.

In this case, the high-pressure-side line 450 and the low-pressure-side line 460 are connected to one another by means of the pressure control valve 42. The electrically controlled pressure control valve 42 has a seal 401 which is composed of an elastomer ring which is resistant to fuel and which separates the low-pressure-side line 460 from the high-pressure-side line 450. By means of the electrically controlled pressure control valve 42, it is possible to regulate the fuel flow within the high-pressure-side line 450 and the low-pressure-side line 460.

The high-pressure-side line 450 and the low-pressure-side line 460 are arranged substantially parallel to one another so as to have the smallest possible spatial requirement.

Furthermore, on the low-pressure-side line 460, there is a return receptacle 47, which is connected in dimensionally rigid fashion to a connecting piece of a return device 472, for example a pressure-resistant line adapter, for the purpose of conducting excess fuel from the low-pressure-side line 460 into the return line when required.

Here, the connecting elements 452, 462, 472 may be connected in pressure-tight fashion to lines. The fuel pressure in the high-pressure-side line may be up to 200 bar, in particular 120 bar, wherein the fuel pressure in the low-pressure-side line is preferably between 2 and 4 bar.

By means of the multiple integration of said functional members in a single component, material costs and in particular installation space, and also weight, are saved.

Figure 9:
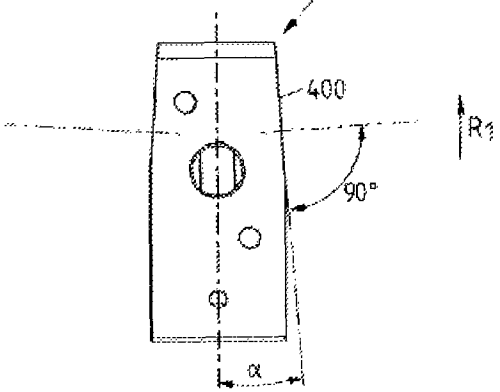
FIG. 9 shows the exemplary embodiment of the fuel destructor block as per FIG. 7 in plan view.

FIG. 9 shows the exemplary embodiment of a fuel distributor block as per FIG. 7 in plan view. In FIG. 9, it can be clearly seen that the base surface 400 is beveled in the direction R2, wherein the direction R2 has already been defined in FIG. 7, by an angle α situated between the plane of symmetry of the fuel distributor block, said plane of symmetry running perpendicular to the plane of the circumferential surface of the belt pulley 72, and the plane of the base surface 400. The range of the angle α is explained in more detail in FIG. 11.

Here, the connecting elements 444 (not illustrated for reasons of clarity) are arranged at an angle of 90° on the base surface 400.

Figure 10:
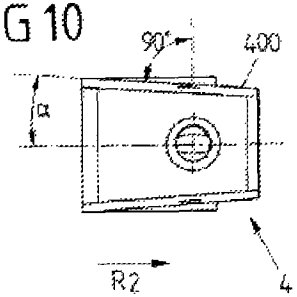
FIG. 10 shows the exemplary embodiment of the fuel distributor block as per FIG. 7 in side view.

FIG. 10 shows the exemplary embodiment of a fuel distributor block as per FIG. 7 in a side view. In FIG. 10, it can be clearly seen that the base surface 400 is beveled in the direction R1, wherein the direction R1 has already been defined in FIG. 7, by an angle α situated between the plane of symmetry of the fuel distributor block, said plane of symmetry running perpendicular to the plane of the circumferential surface of the belt pulley 72, and the plane of the base surface 400. The range of the angle α is explained in more detail in FIG. 11.

Here, the connecting elements 444 (not illustrated for reasons of clarity) are arranged at an angle of 90° on the base surface 400.

Figure 11:
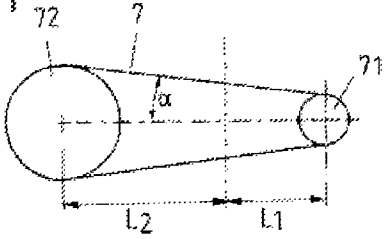
FIG. 11 shows a schematic view of a belt with two belt pulleys.

FIG. 11 shows a schematic view of a belt with two belt pulleys. The illustration of FIG. 11 corresponds to an imaginary "straightening-out" of the belt arrangement and a view from above. As can be clearly seen in FIG. 11, the angle α, which is situated between the connecting line of the two central points of the belt pulleys 71, 72 and the tangent to the circumference of the belt pulleys 71, 72, is determined from the diameter of the belt pulleys 71, 72, and consequently from the transmission ratio of the two belt pulleys 71, 72. In this case, the diverting device divides the belt 7 into the sections L1 and L2.

The adaptation of the base surface 400 to the angle α and thus the adaptation of the position of the bearing shaft 444 allows the belt 7 to run over the diverting device 44 with minimal wear, in particular if the diverting device 44 is in the form of a rolling bearing, and thus permits smooth and reliable operation.

Figure 12:
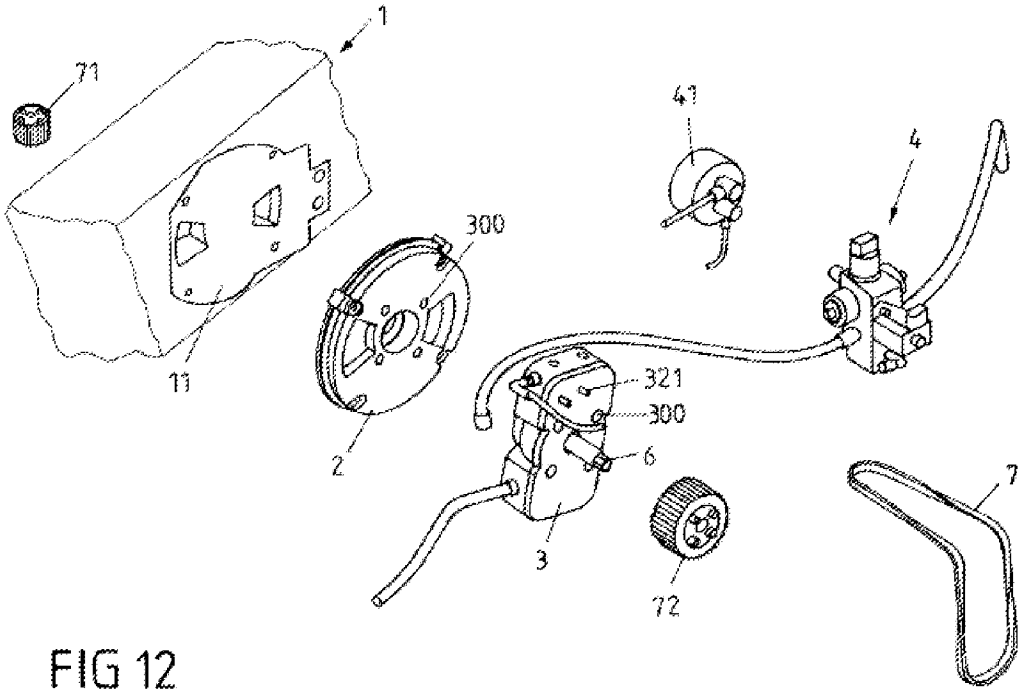
FIG. 12 shows a schematic view of an engine system having the rotary disk valve arrangement as per FIG. 1, the fuel pump as per FIG. 5 and the fuel distributor block as per FIG. 7.

FIG. 12 shows a schematic view of an engine system having the rotary disk valve arrangement as per FIG. 1, the fuel pump as per FIG. 5 and the fuel distributor block as per FIG. 7.

As already described, the rotary disk valve arrangement 2 may be fastened to the crankcase 1. Furthermore, the fastening devices 300 are provided on the rotary disk valve arrangement 2 for the purposes of fastening the fuel pump 3 to the rotary disk valve arrangement 2. Here, the fuel pump 3 has fastening elements 321 by means of which the fuel distributor block 4 can be fastened to the fuel pump 3 by way of the fastening openings 320 (see also FIG. 7).

Here, a coupling shaft 6 is arranged in the fuel pump 3, which coupling shaft is operatively connected in positively locking fashion to the first rotary disk valve 21 and is coupled to the belt pulley 72. Here, the first belt pulley 71, which is merely schematically illustrated and is arranged on the crankcase 1, may be coupled to the crankshaft of the crankcase 1 and thus transmit a torque to the second belt pulley 72, so as to consequently drive the coupling shaft 6.

Figure 13:
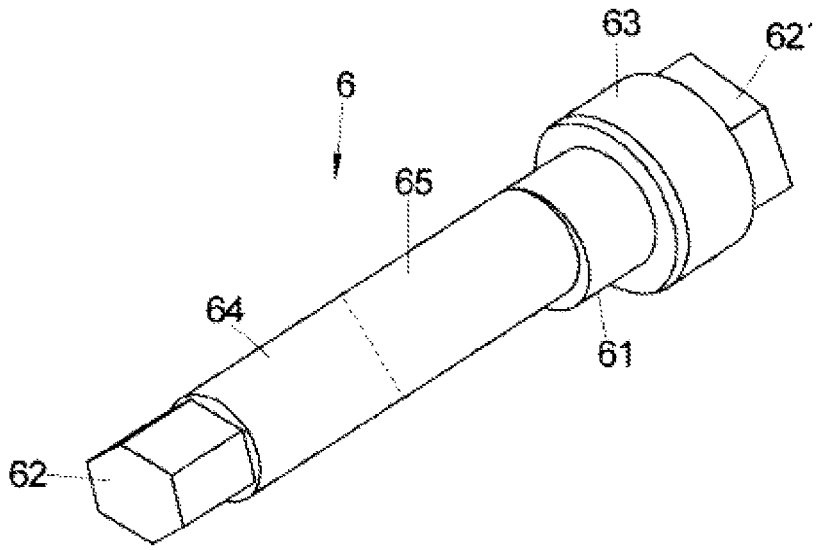
FIG. 13 shows a crankshaft which can be arranged on the rotary disk valve arrangement as per FIG. 1, the fuel pump as per FIG. 5 and a belt pulley of the fuel distributor block as per FIG. 7.

FIG. 13 shows a crankshaft which is arranged on the rotary disk valve arrangement as per FIG. 1, on the fuel pump as per FIG. 5 and on a belt pulley of the fuel distributor block as per FIG. 7.

Here, the coupling shaft 6 has coupling surfaces 62' for the positively locking connection of the first rotary disk valve 21, and a bearing seat 63 for a rolling bearing for the mounting of the coupling shaft. Furthermore, the coupling shaft 6 has a cranked portion 61 for the transmission of force to a rolling bearing, a further bearing seat 65 for a rolling bearing for the mounting of the coupling shaft, and a mounting surface 64 for a belt pulley 72, which is operatively connected in a positively locking manner by way of the coupling surface 62.

Also illustrated is a pulsation damper 41 which can be arranged on the fuel distributor block and which is designed to dampen pressure oscillations in the fuel line system.

By means of the multiple integration of said functional members in a single component, material costs and in particular installation space, and also weight, are saved.

An engine system having a rotary disk valve arrangement 2 as per the exemplary embodiment of FIG. 1, a fuel pump 3 as per the exemplary embodiment of FIG. 5 and a fuel distributor block 4 as per the exemplary embodiment of FIG. 7 is characterized in particular in that a considerable minimization of installation space, weight, number of parts, fuel consumption, pollutant emissions and outlay in terms of manufacture is achieved in relation to other internal combustion engines in similar performance classes.

LIST OF REFERENCE SIGNS

1 Crankcase
10 Coupling surface
100 Receiving device
11, 11' Inlet openings
111, 112 Side edges of the inlet opening
12 Lubrication bore opening
2 Rotary disk valve arrangement
21 First rotary disk valve
22 Second rotary disk valve
23, 23' First rotary valve openings
24, 24' Second rotary valve openings
25 First cover
26 Second cover
27, 27' First cover openings
28, 28' Second cover openings
29 Seal
200 Fastening opening
201 First rotary disk valve chamber
202 Second rotary disk valve chamber
203 Plain bearing
213 Lubrication opening
222 Stop device
223 Guide ring
224 Receiving opening
225 Guide tabs
230 Stop
231, 232, 231', 232' Side edges of the first rotary valve openings
240 Idle bores
271, 272, 271', 272' Side edges of the first cover openings
281, 282, 281', 282' Side edges of the second cover openings
2000 Connecting element
300 Attachment device
3 Fuel pump
30 Eccentric

31 Eccentric chamber
33 Compression piston
34 Spring
35 Outer circumferential surface
36 Cylinder liner
37 Rolling bodies
38 Inner circumferential surface
301 Elastomer ring
302 Plate spring
320 Fastening opening
321 Fastening elements
4 Fuel distributor block
41 Pulsation damper
42 Pressure control valve
43 Pressure sensor
44 Belt diverting device
45 High-pressure inlet receptacle
46 High-pressure outlet receptacle
47 Return receptacle
400 Base surface
401 Seal
403 Eccentric sleeve
420 Pressure control valve receptacle
430 Pressure sensor receptacle
440 Diverting element
444 Connecting element
450 High-pressure-side line
452 Connecting element of a feed device
460 Low-pressure-side line
462 Connecting element of a discharge device
470 Return device
472 Connecting piece of a return device
5 Crankshaft
6 Coupling shaft
61 Cranked portion
62, 62' Coupling surface
63, 65 Bearing seat for a rolling bearing
7 Mounting surface
7 Belt
71 First belt pulley
72 Second belt pulley

The invention claimed is:

1. An engine system comprising:

(a) a fuel pump for compressing fuel, the fuel pump having:

at least two compression pistons, an eccentric chamber in which the at least two compression pistons are mounted in axially displaceable fashion, and a rotatably mounted eccentric device for driving the at least two compression pistons, and which is accommodated in the eccentric chamber, wherein the eccentric chamber and the at least two compression pistons are operatively connected to one another such that the two compression pistons are axially displaced for the compression of fuel, and wherein the eccentric chamber is at least partially to be filled with lubricant; and (b) a rotary disk valve arrangement having:

a crankcase for accommodating a crankshaft, wherein the crankcase has a first inlet opening for fresh air and a coupling surface with a least one second inlet opening, and at least two rotary disk valves for regulating an ingress of fresh air into the crankcase, the at least two rotary disk valves being arrange at the coupling surface of the crankcase, wherein the at least two rotary disk valves are respectively rotatable about an axis of rotation and are mounted so as to be rotatable relative to one another for the purpose of at least partially opening up and closing off the first and second inlet openings, and the at least two rotary disk valves each comprising at least two rotary valve openings for the purpose of at least partially uncovering the at least two inlet openings by rotating the respective rotary disk valve in such a way that a rotary valve opening lies adjacent to at least one of the first and second inlet openings.

2. The engine system as claimed in claim 1, wherein a coupling shaft and a rolling body are provided for transmitting a force to the eccentric device and a transmission of force from the coupling shaft to an outer circumferential surface of the eccentric device takes place via the rolling body, which is arranged between the outer circumferential surface and an inner circumferential surface of the eccentric.

3. The engine system as claimed in claim 1, wherein the at least two compression pistons are each mounted radially elastically in a respective cylinder liner.

4. The engine system as claimed in claim 3, characterized in that the at least two compression pistons are each mounted radially elastically in a respective cylinder liner by means of at least one elastomer ring, and/or the at least two compression pistons are each mounted in axially elastic fashion in a respective cylinder liner, in particular by means of at least one plate spring.

5. The engine system as claimed in claim 4, characterized in that the at least two compression pistons are each mounted in axially elastic fashion in a respective cylinder liner by means of at least one plate spring.

6. The engine system as claimed in claim 1, also comprising:

a fuel distributor block for an internal combustion engine, having a belt arrangement, wherein the belt arrangement comprises a belt and at least a first belt pulley and a second belt pulley, wherein the belt is operatively connected to the first belt pulley and the first pulley is coupled to a shaft, and wherein the second belt pulley, for the purpose of driving an assembly of the engine, is also operatively connected to the belt, wherein a belt diverting device for diverting the belt is arranged on the fuel distributor block in order to minimize the spatial extent of the belt arrangement.

7. The new engine system as claimed in claim 1, characterized in that the at least two compression pistons are each mounted in axially elastic fashion in a respective cylinder liner, in particular by means of at least one plate spring.

* * * * *